US008459472B2

(12) United States Patent
Hofman

(10) Patent No.: US 8,459,472 B2
(45) Date of Patent: Jun. 11, 2013

(54) KEYED TWIST-LOCK HOOK ASSEMBLY FOR APERTURE BOARD

(75) Inventor: James A. Hofman, Shorewood, MN (US)

(73) Assignee: Top-Wok Metals Co. Ltd. (CN)

( * ) Notice: Subject to any disclaimer, the term of this patent is extended or adjusted under 35 U.S.C. 154(b) by 549 days.

(21) Appl. No.: 12/648,764

(22) Filed: Dec. 29, 2009

(65) Prior Publication Data

US 2011/0155875 A1 Jun. 30, 2011

(51) Int. Cl.
*A47G 25/06* (2006.01)

(52) U.S. Cl.
USPC ..... 211/106.01; 211/59.1; 248/220.31; 248/222.52; 248/304

(58) Field of Classification Search
USPC .... 211/106.01, 87.01, 59.1, 189; 248/222.41, 248/304, 222.13, 231.31, 220.31, 220.41, 248/220.42, 220.43, 222.51, 222.52, 222.11, 248/222.12; 403/348, 349
See application file for complete search history.

(56) References Cited

U.S. PATENT DOCUMENTS

| | | | | | |
|---|---|---|---|---|---|
| 423,730 | A * | 3/1890 | Charlton | 248/222.52 |
| 478,025 | A * | 6/1892 | Schraudner | 248/222.13 |
| 988,743 | A * | 4/1911 | Stillwaggon | 248/222.52 |
| 2,060,760 | A * | 11/1936 | Keil | 211/106.01 |
| 2,988,315 | A * | 6/1961 | Saxe | 248/220.22 |
| 3,154,281 | A * | 10/1964 | Charles | 248/201 |
| 3,191,777 | A * | 6/1965 | Willits, Jr. | 211/106.01 |
| 3,255,987 | A | 6/1966 | Gatch | |
| 3,310,271 | A * | 3/1967 | King | 248/220.43 |
| 3,443,783 | A * | 5/1969 | Fisher | 248/239 |
| 3,880,390 | A * | 4/1975 | Niven | 248/220.43 |
| 3,944,176 | A * | 3/1976 | Danko | 248/68.1 |
| 4,069,920 | A * | 1/1978 | Ross | 211/106.01 |
| 4,372,450 | A * | 2/1983 | Licari et al. | 211/106.01 |
| 4,582,284 | A * | 4/1986 | Veenstra | 248/220.21 |
| 4,860,905 | A | 8/1989 | Schott et al. | |
| 4,951,827 | A | 8/1990 | Moransais | |
| 5,261,758 | A * | 11/1993 | Vranish | 403/348 |
| 5,503,277 | A * | 4/1996 | O'Brien | 211/106.01 |
| 5,529,192 | A * | 6/1996 | Conen et al. | 211/189 |
| 5,531,415 | A | 7/1996 | Kallemeyn | |
| 5,554,165 | A * | 9/1996 | Raitt et al. | 606/176 |
| 5,597,260 | A * | 1/1997 | Peterson | 403/319 |
| 5,768,809 | A | 6/1998 | Savoie | |
| 5,871,222 | A * | 2/1999 | Webb | 280/511 |
| 6,108,944 | A | 8/2000 | Savoie | |
| 6,134,846 | A * | 10/2000 | Lamb | 52/36.5 |
| 6,151,805 | A | 11/2000 | Savoie | |
| 6,267,373 | B1 * | 7/2001 | Takata | 271/274 |
| 6,332,281 | B1 | 12/2001 | Savoie | |
| 6,397,499 | B1 | 6/2002 | Savoie | |
| 6,574,924 | B2 * | 6/2003 | Maniezzo | 52/36.4 |
| 6,935,518 | B2 * | 8/2005 | Winig et al. | 211/90.02 |
| 7,147,399 | B2 * | 12/2006 | Viscount et al. | 403/349 |
| 7,204,375 | B2 * | 4/2007 | Paiste et al. | 211/85.6 |
| 2010/0264102 | A1 * | 10/2010 | Barkdoll et al. | 211/106.01 |

* cited by examiner

*Primary Examiner* — Korie H Chan
(74) *Attorney, Agent, or Firm* — Luedeka Neely Group, P.C.

(57) ABSTRACT

An aperture board assembly includes a panel having an array of apertures, a modular array of receivers attached to the panel, and hook assemblies for detachably engaging the receivers. The modular array is attached to the panel so that each receiver is substantially aligned with a corresponding aperture in the panel. Each hook assembly passes at least partially through an aperture in the panel and into a receiver aligned with the aperture. Each receiver in the modular array includes spring clips that are equally spaced apart around a perimeter of the receiver. Each spring clip includes a pair of opposing spring fingers disposed in a spring clip aperture. Each pair of opposing spring fingers detachably engage the hook assembly as the hook assembly is rotated with respect to the receiver.

17 Claims, 8 Drawing Sheets

(SECTION A-A)

KEYED TWIST-LOCK HOOK ASSEMBLY FOR APERTURE BOARD

FIELD

This invention relates to aperture boards that receive hooks and other accessories for storing items. More particularly, this invention relates to a keyed twist-lock fastener for holding a hook or other accessory to an aperture board.

BACKGROUND

Aperture boards, also referred to as pegboards, have long been used for hanging storage of items. These aperture boards, which typically attach to a wall or other vertical surface, include an array of apertures for receiving hooks and other accessories. The hooks generally have an insertion portion that passes through an aperture in the board and makes contact with the back side of the board. The contact of the insertion portion to the back of the board holds the hook to the board when a downward vertical load is applied to the hook.

A problem with prior aperture board hook designs is the tendency for the hook to come loose from the board when an item hanging on the hook is removed. The removal of the hanging item sometimes causes a lifting force or rotational force or both to be applied to the hook, which may cause the insertion portion of the hook to come loose from the aperture.

What is needed, therefore, is a fastener mechanism for an aperture board that provides for easy attachment of a hook or other accessory, and which holds firmly to the board when a hanging item is engage with or removed from the hook.

SUMMARY

The above and other needs are met by an aperture board assembly that includes a panel having an array of apertures, a modular array of receivers attached to the panel, and hook assemblies for detachably engaging the receivers. Each aperture in the array is spaced from an adjacent aperture according to a first spacing, and each receiver of the modular array is spaced from an adjacent receiver according to the first spacing. The modular array is attached to the panel so that each receiver is substantially aligned with a corresponding aperture in the panel. Each hook assembly passes at least partially through an aperture in the panel and into a receiver aligned with the aperture. The hook assembly detachably engages the receiver as the hook assembly is rotated with respect to the receiver.

In some embodiments, the panel of the aperture board assembly includes opposing edge channels, and the modular array is slidingly received within the edge channels. In some embodiments, a second modular array of receivers may be attached to the panel so that each receiver of the second modular array is substantially aligned with a corresponding aperture in the panel. The two modular arrays of receivers may be disposed adjacent each other or they may be spaced apart in different regions of the panel.

In some embodiments, each receiver in the modular array includes one or more spring clips configured to detachably engage the hook assembly as the hook assembly is rotated with respect to the receiver. Preferably, there are two or more spring clips in each receiver which are equally spaced apart around a perimeter of the receiver. In a preferred embodiment, each spring clip includes a pair of opposing spring fingers disposed in a spring clip aperture. Each pair of opposing spring fingers of this embodiment detachably engages the hook assembly as the hook assembly is rotated with respect to the receiver.

In some embodiments, the hook assembly includes a spoked key which passes through an aperture in the panel and into the corresponding receiver aligned with the aperture. The spoked key has a number of radially extending spokes, the number of which equals the number of spring clips in the receiver. In a most preferred embodiment, the spoked key has three radially extending spokes, and each receiver has three spring clips which detachably engage the three spokes. Each pair of opposing spring fingers detachably engages a corresponding spoke of the spoked key as the hook assembly is rotated with respect to the receiver.

Preferably, one or more of the apertures in the panel are spoked apertures having a spoked shape, and the spoked key of the hook assembly matches the spoked shape of the apertures.

In a preferred embodiment, each receiver in the modular array includes a back plate, and the hook assembly includes one or more springs which engage the back plate of the receiver as the hook assembly passes into the aperture. In this embodiment, the engagement of the one or more springs against the back plate urges the hook assembly away from the back plate. The one or more springs of the hook assembly may comprise spokes which are configured to match the spoked shape of the spoked apertures in the panel.

The modular array of receivers may include means, such as a slotted hole, for attaching the first modular array to a wall. Preferably, the slotted hole or other means are hidden from view when the panel is attached to the modular array.

In some embodiments, the hook assembly includes a shank with one or more accessories attached to the shank. The accessories may be, for example, hooks, posts, loops, brackets, fasteners, or hangers. The hook assembly may also include a flange configured to substantially hide an aperture in the panel from view when the hook assembly is engaged with a receiver aligned with the aperture.

In another aspect, the invention provides a hook assembly for use on an aperture board. In preferred embodiments, the hook assembly includes a shank for receiving items to be hung on the aperture board, a flange disposed rearward of the shank, a spoked key disposed rearward of the flange, and one or more springs disposed rearward of the spoked key. The flange is configured to substantially hide from view the aperture in the panel into which the hook assembly is inserted. The spoked key has a number of radially extending key spokes which may be aligned with radially extending spokes of a spoked aperture in the aperture board. The one or more springs are configured to urge the hook assembly in a direction substantially perpendicular to the aperture board when the spoked key is inserted into an aperture in the aperture board. In some embodiments, the one or more springs include, radially extending spring spokes, the number of which match the number of key spokes.

In a preferred embodiment, the shank and flange of the hook assembly are integrally formed as a single piece of plastic, and the spoked key, and springs are attached to the single-piece shank and flange by ultrasonic welding.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
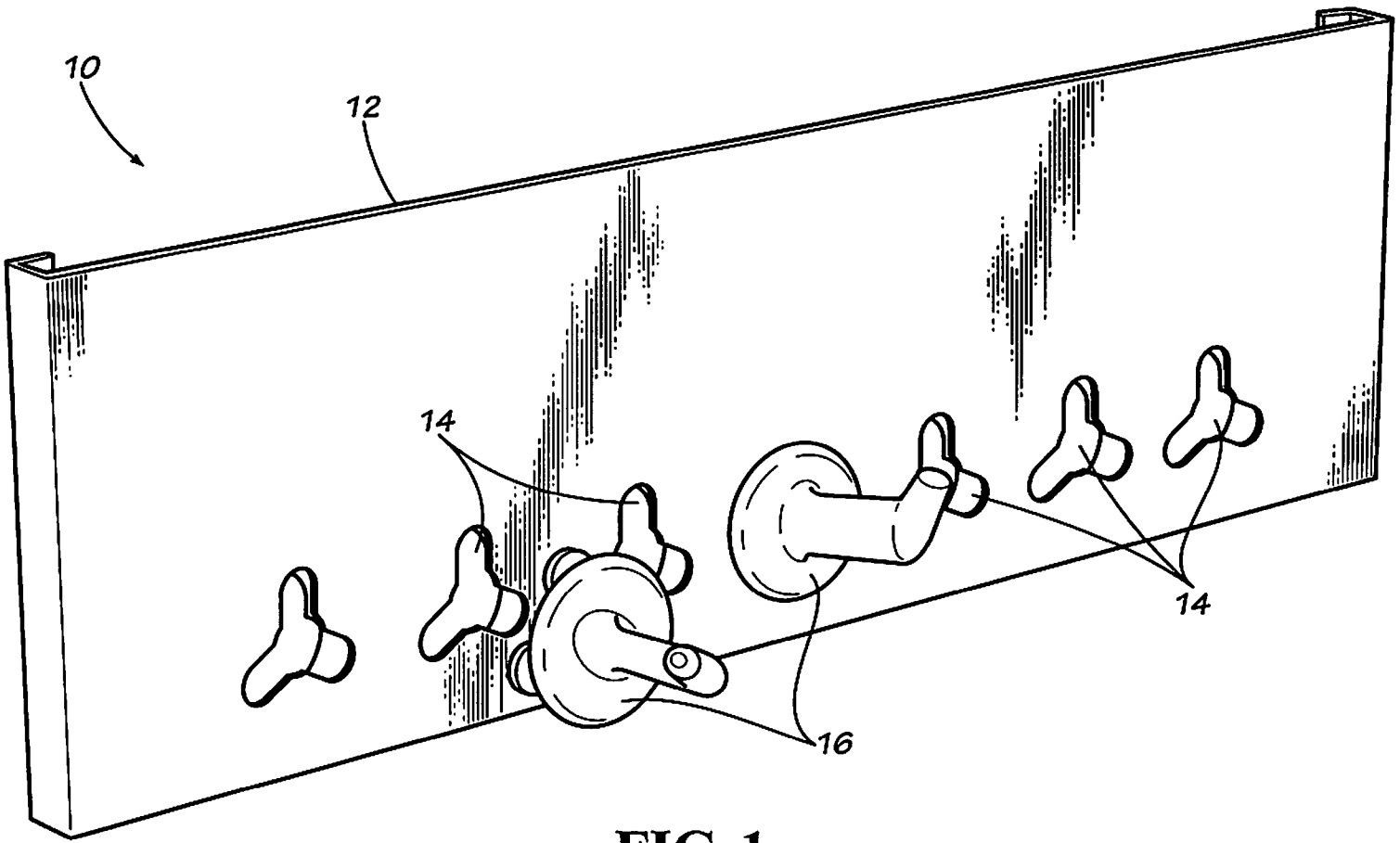
FIG. 1 depicts an aperture board with hook assemblies attached thereto.

As shown in FIG. 1, an aperture board assembly 10 includes a front panel 12 having an array of keyed apertures 14 for receiving hook assemblies 16. As described in more detail below, a hook assembly 14 attaches to the front panel 12 by inserting a keyed portion of the hook assembly 16 into the keyed aperture 14 and rotating the hook assembly 16 to lock it in place.

Figure 2A:
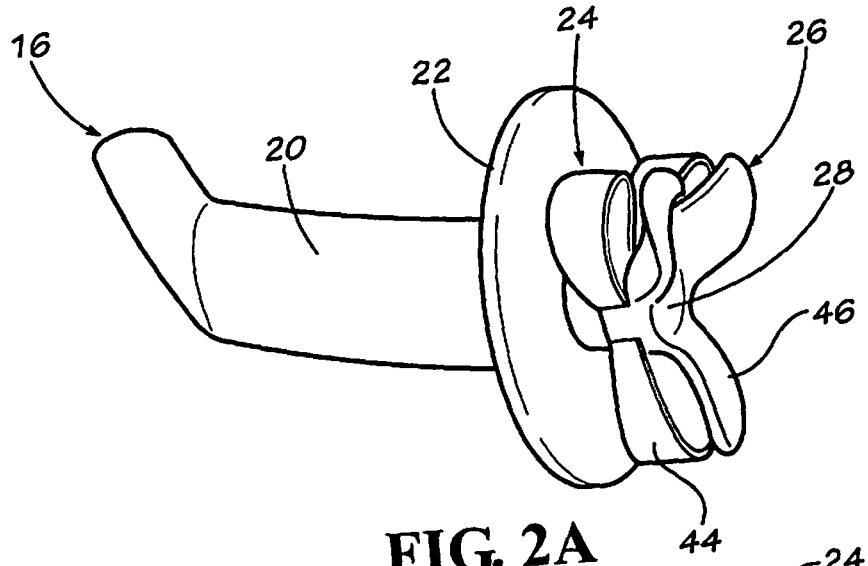
FIGS. 2A, 2B and 2C depict a hook assembly.
Figure 2B:
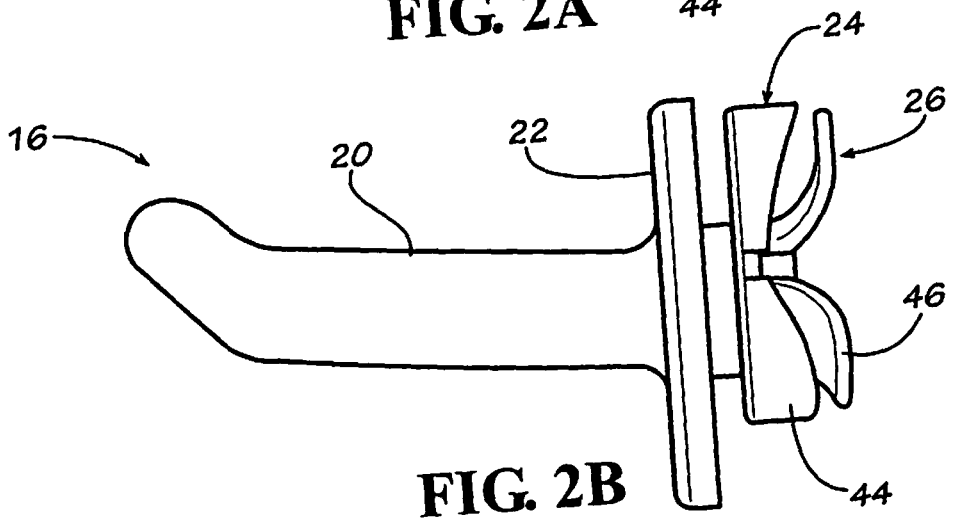
Figure 2C:
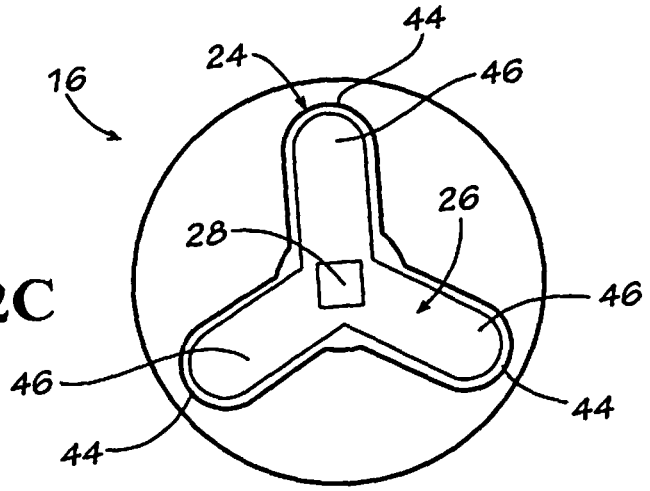

FIGS. 2A-2C depict an embodiment of a hook assembly 16. The hook assembly 16 preferably includes a hook shank 20, a flange 22, a spoked key 24, a spring 26, and a keyed attachment post 28 (FIG. 3C) extending from the backside of the flange 22. As shown in FIG. 2C, a preferred embodiment of the spoked key 24 includes three spokes 44 spaced at 120 degrees. Similarly, a preferred embodiment of the spring 26 includes three spokes 46 spaced at 120 degrees.

In one embodiment, the hook shank 20, flange 22 and attachment post 28 are formed as one piece of ABS plastic, such as by injection molding. The spoked key 24 and spring 26 of this embodiment are preferably formed as separate pieces, such as by injection molding, with each having a keyed hole matching the keyed attachment post 28. The hook assembly 16 of this embodiment is assembled by sliding the spoked key 24 and spring 26 onto the attachment post 28 and ultrasonically welding them in place. In other embodiments, the spoked key 24 and spring 26 may be attached to the shank 20 or flange 22 using a threaded fastener or other fastener means.

Although plastic is a preferred material for the components of the hook assembly 16, each component may be formed of other materials, such as metal, wood or ceramic, to achieve a desired strength or ornamental appearance. Thus, it will be appreciated that the hook assembly 16 is not limited to any particular material or mode of construction.

As used herein, the phrase "hook assembly" refers to any hook, post, loop, bracket, fastener, hanger, or other accessory that may be attached to the aperture board assembly 10. Thus, the phrase "hook assembly" is an all-inclusive term, and is not limited to hooks only.

Figure 3A:
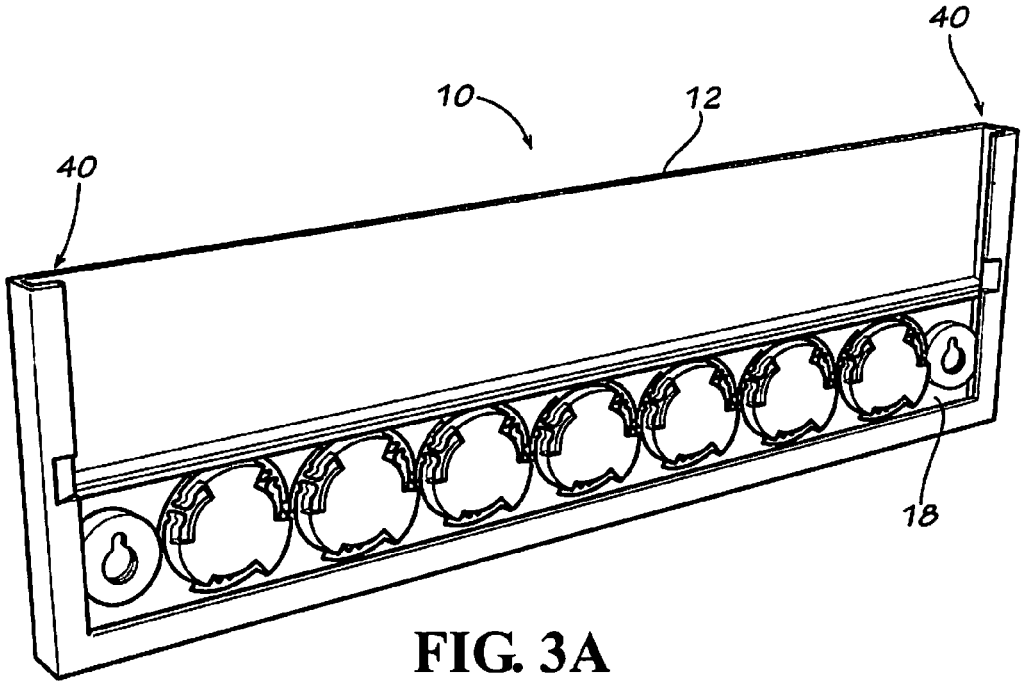
FIG. 3A depicts the backside of an aperture board having a single modular array of receivers.
Figure 3B:
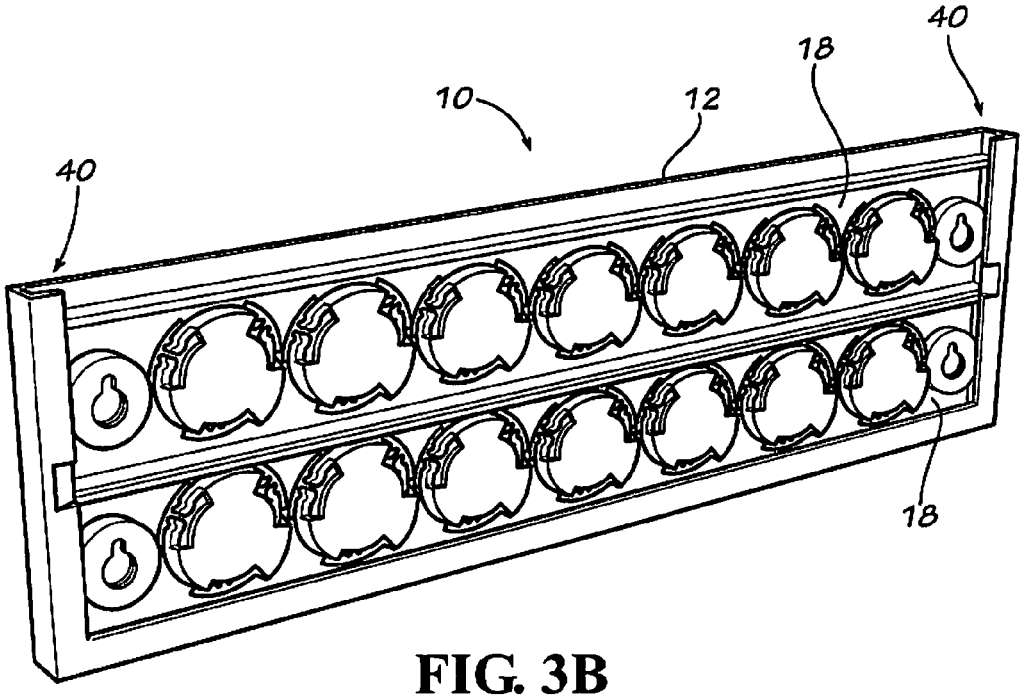
FIG. 3B depicts the backside of an aperture board having two modular arrays of receivers.

FIGS. 3A and 3B depict the rear side of two embodiments of the aperture board assembly 10. The embodiment of FIG. 3A includes a single modular receiver array 18 which is slidingly received within edge channels 40 disposed along the outer edge of the front panel 12. In a preferred embodiment, the front panel 12 is formed of sheet metal, and the edge channels 40 are formed by bending the sheet metal. However, it will be appreciated that the front panel 12 may be formed of plastic, wood, or other materials. The embodiment of FIG. 3B includes two modular receiver arrays 18 which are slidingly received in a stacked configuration within the edge channels 40.

Figure 4A:
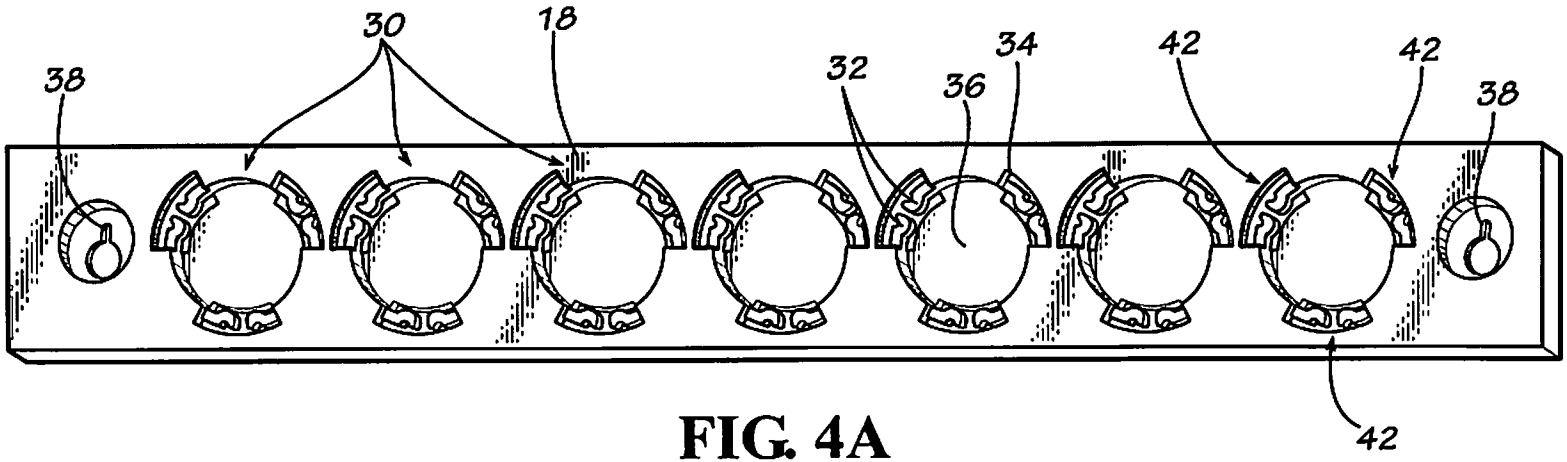
FIGS. 4A and 4B depict views of a modular array of receivers.
Figure 4B:
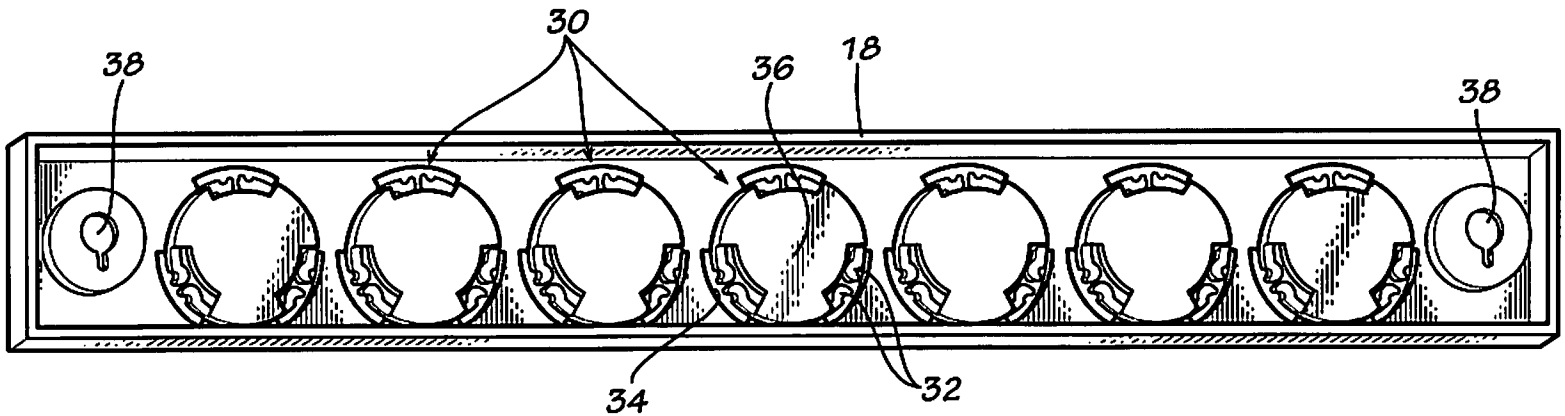

FIGS. 4A and 4B depict front and rear views, respectively, of an embodiment of a modular receiver array 18. The array 18 is preferably formed of ABS plastic in an injection molding process. However, the array 18 could be formed of metal or other suitable materials. The array 18 includes receivers 30 which are preferably equally spaced along its length. When viewed from the front, each receiver 30 comprises a circular depression or cup about to inch deep having a back plate 36. In the embodiments depicted in the figures, each receiver 30 includes three spring clips 42 equally spaced at 120 degree increments. Each spring clip 42 comprises a pair of spring fingers 32 disposed within a spring clip aperture 34. For reasons discussed in more detail below, the inside edges of the spring fingers 32 bulge inward toward the center of the receiver 30.

Although a preferred embodiment of the receiver includes three spring clips spaced at 120 degree increments around the perimeter, other numbers of spring clips could be provided in other embodiments. For example, alternative embodiments may include two spring clips separated by 180 degrees, or four spring clips separated by 90 degrees. Thus, it will be appreciated that the invention is not limited to any particular number of spring clips or any particular angular spacing between spring clips.

Similarly, alternative embodiments of the spoked key of the hook assembly may include two spokes spaced at 180 degrees or four spokes spaced at 90 degrees or other numbers of spokes. Thus, it will be appreciated that the invention is not limited to any particular number of spokes or any particular angular spacing between spokes in the spoked key.

In a preferred embodiment, cups 38 are provided at each end of the modular array 18, each cup 38 having an aperture/slot for receiving a screw or other fastener for attaching the array 18 to a wall or other surface. Preferably, the depth of the cups 38 are set such that the edge channels 40 of the front panel 12 may slide between the wall and the back edge of the array 18 when the array 18 is attached to the wall. With this configuration, one or more arrays 18 may be attached to the wall, and then the front panel 12 may slide onto and be supported by the array(s) 18.

Figure 5A:
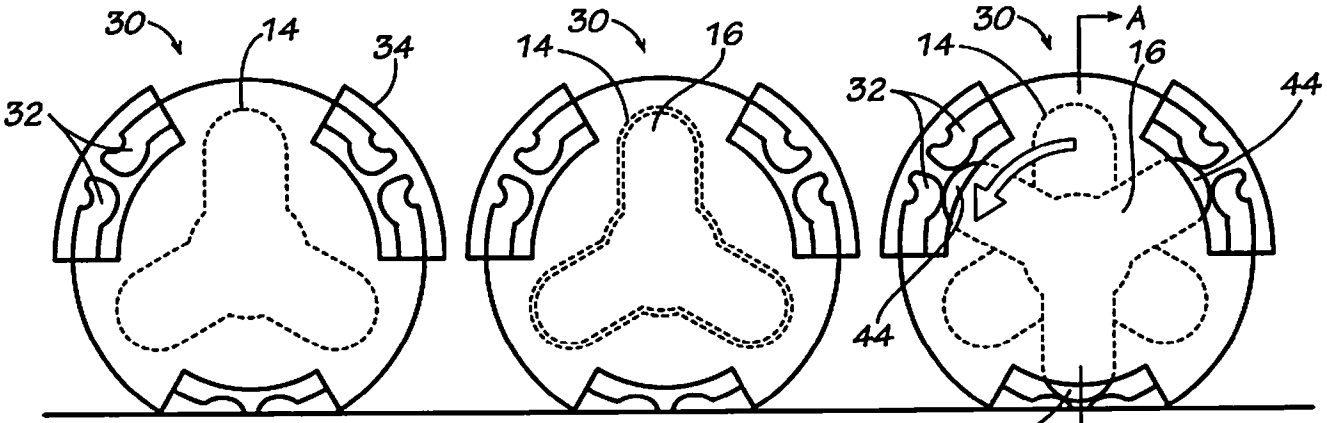
FIG. 5A is a back side view of receivers in a modular array.

As shown in FIGS. 1 and 5A, when the front panel 12 is attached to the array 18, the keyed apertures 14 in the front panel 12 align with the receivers 30 in the array 18. FIG. 5A is a view of the backside of three adjacent receivers 30, with the locations of the corresponding keyed apertures 14 in the front panel indicated by dashed lines. In the center receiver 30, a hook assembly 16 has been inserted, the spoked key of which is shown in dashed outline. In the right-hand receiver 30, a hook assembly 16 has been inserted and rotated 60 degrees. In this position, each spoke 44 of the spoked key engages the inward bulges of the spring fingers 32 of a corresponding spring clip 42, urging the fingers 32 outward. Once the hook assembly 16 is rotated and locked into this position, a significant rotational force is needed to dislodge the spokes 44 from the spring fingers 32.

Figure 5B:
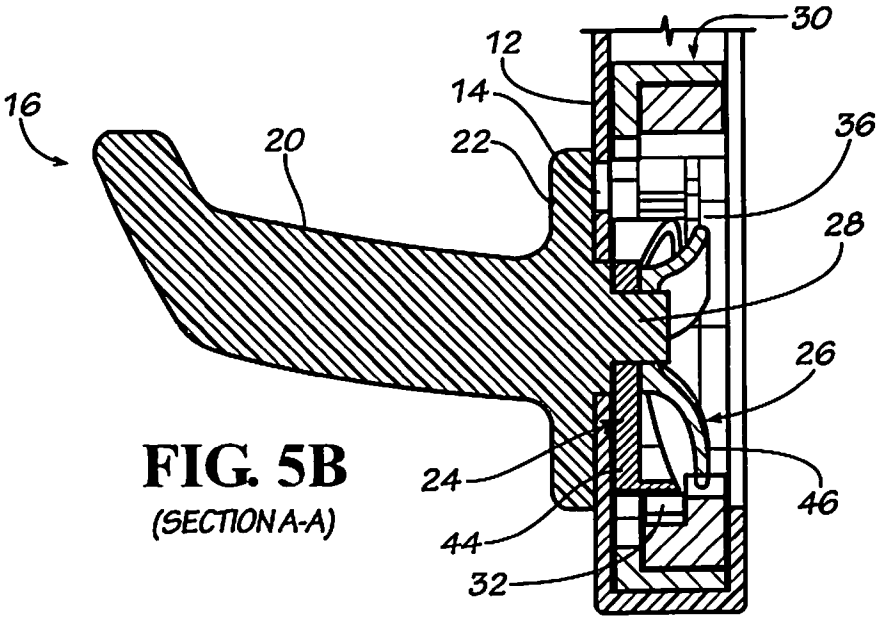
FIG. 5B is a cross-section view of a hook assembly locked into a receiver.
Figure 6A:
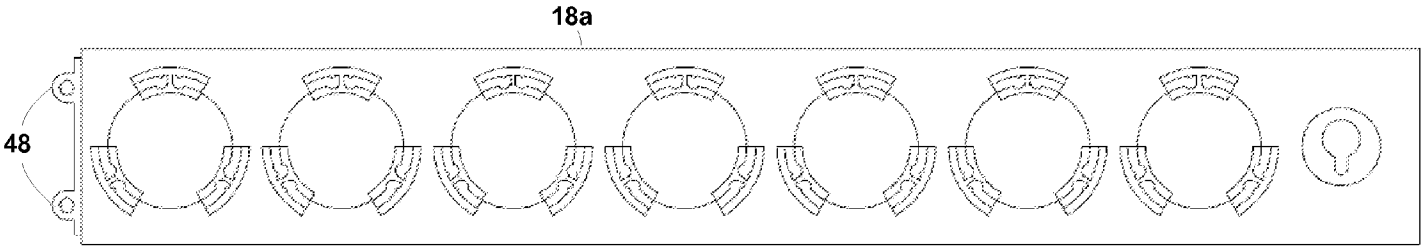
FIGS. 6A, 6B, 6C, and 6D depict views of a modular array of receivers.
Figure 6B:
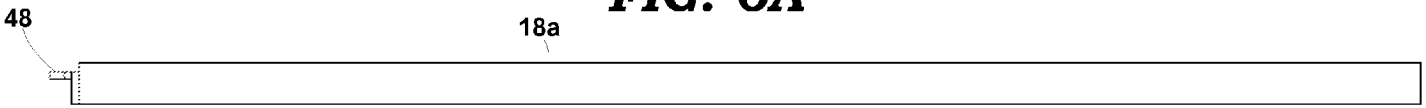
Figure 6C:
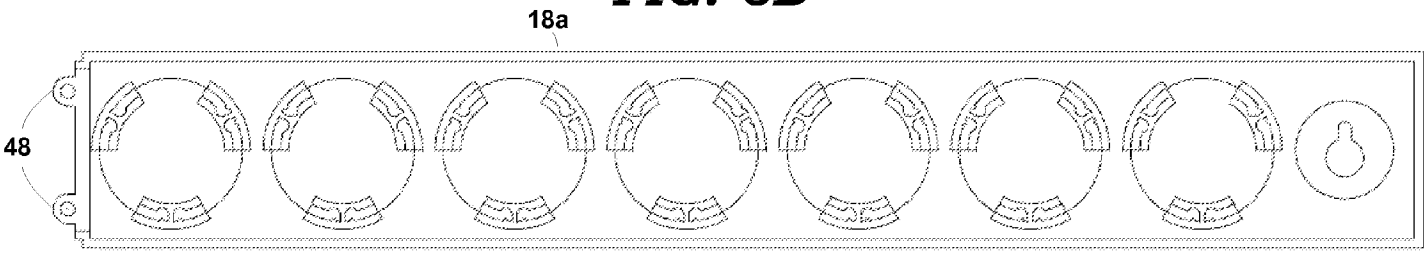
Figure 6D:
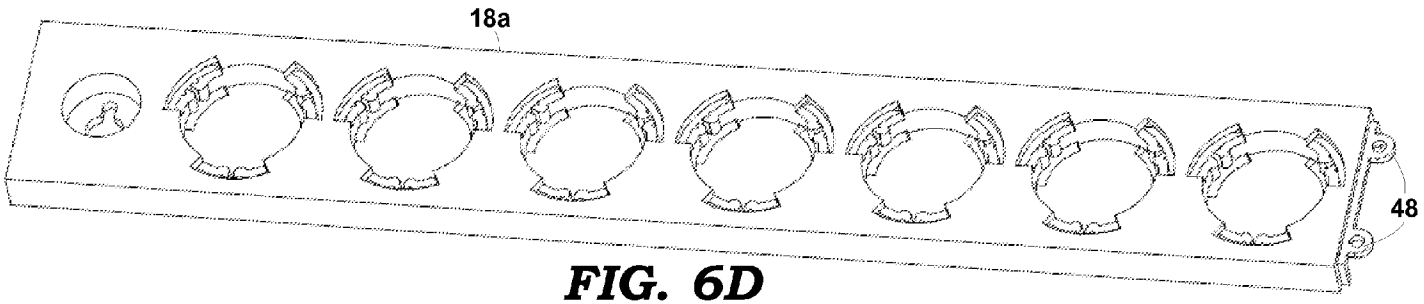
Figure 7A:
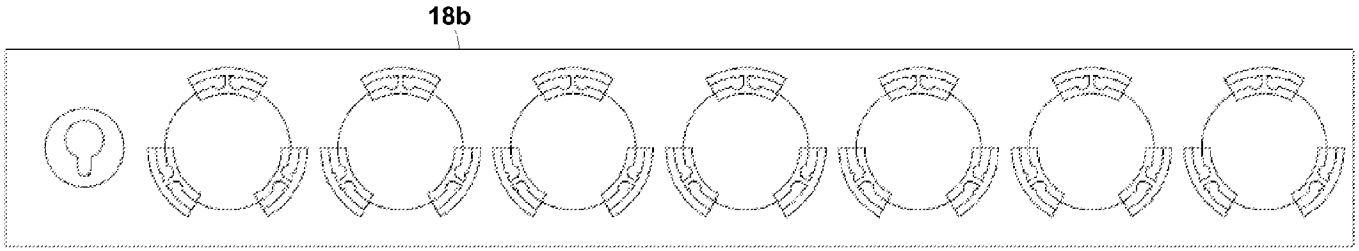
FIGS. 7A, 7B, 7C, and 7D depict views of a modular array of receivers.
Figure 7B:
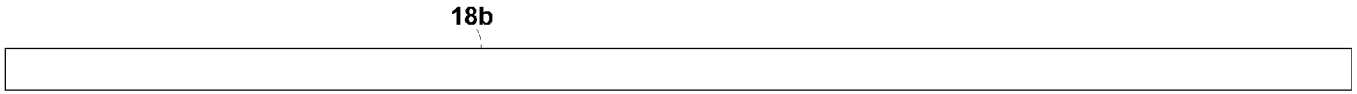
Figure 7C:
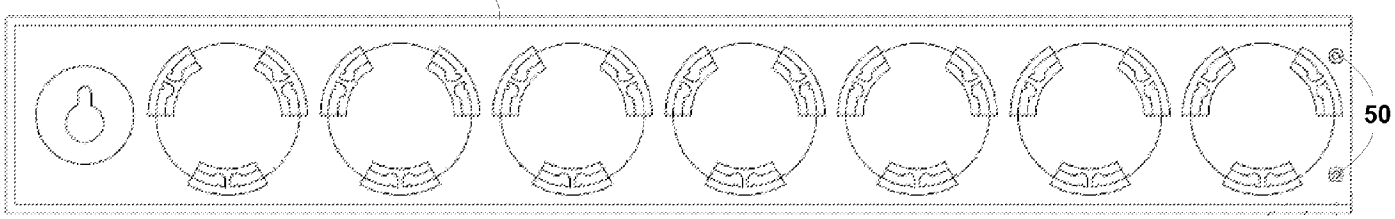
Figure 7D:
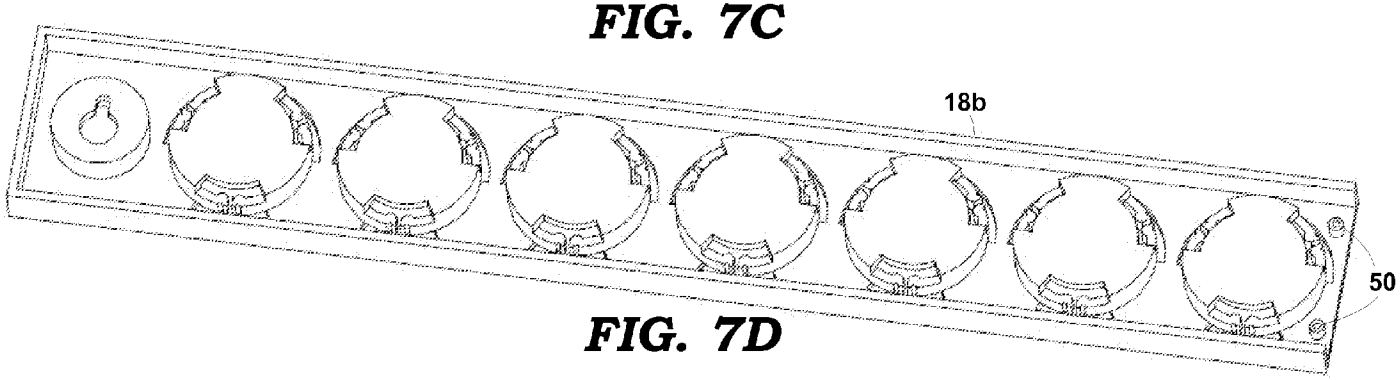

FIG. 5B depicts a cross-section view corresponding to section A-A of FIG. 5A. As shown in FIG. 5B, the spokes 46 of the spring 26 press against the back plate 36 of the receiver 30, thereby providing counter-pressure so that the front surfaces of the spoked key 24 press firmly against the backside of the front panel 12. This counter-pressure ensures a firm and stable attachment of the hook assembly 16 to the front panel 12.

In the preferred embodiment, the spring 26 includes spokes 46 (or leaves or petals) which press against the back plate 36 as described above. In alternative embodiments, the spring 26 may be a helical spring or other spring mechanism. Thus, it will be appreciated that the invention is not limited to any particular type of spring mechanism for providing the counter-pressure described above.

Figure 8A:
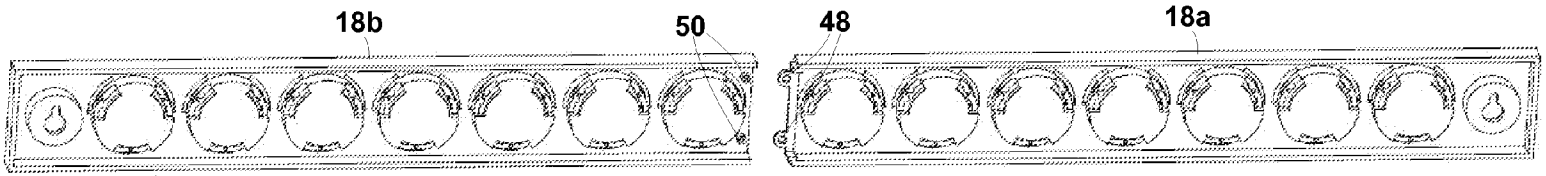
FIGS. 8A, 8B, and 8C depict views of an assembly of modular arrays of receivers.
Figure 8B:
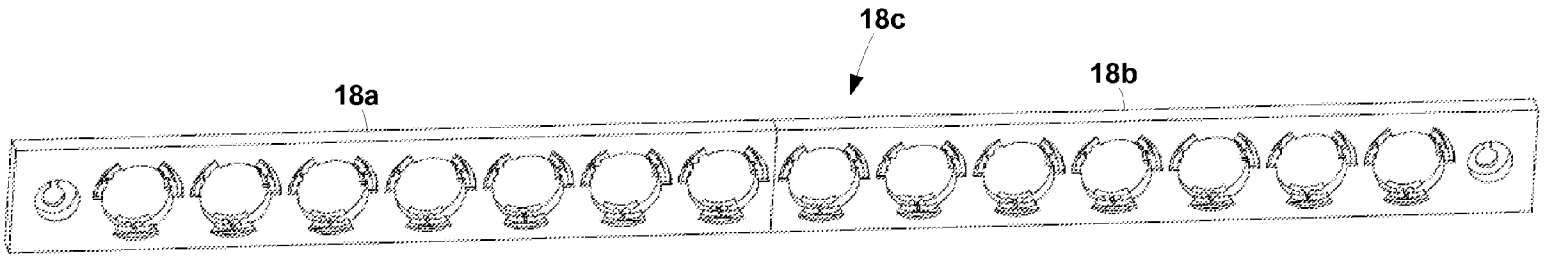
Figure 8C:
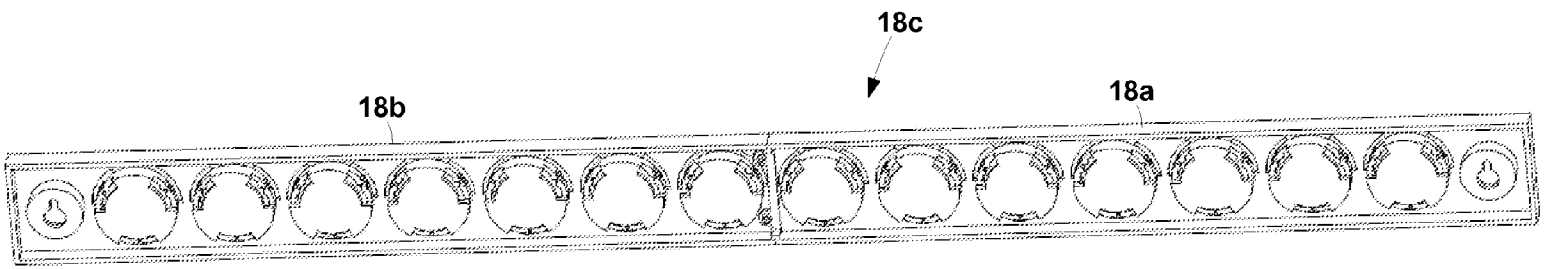

FIGS. 6A, 6B, 6C, and 6D depict a third modular array of receivers 18*a* having a pair of tabs 48 extending from one end. FIGS. 7A, 7B, 7C, and 7D depict a fourth modular array of receivers 18*b* having a pair of posts 50 disposed near one end. The end of the fourth array 18*b* adjacent the posts 50 is open so as to receive the tabs 48 of the third array 18*a* when the third and fourth arrays are joined to form an assembly 18*c* of modular arrays as shown in FIGS. 8A, 8B, and 8C. Each tab 48 has a hole which aligns with a blind hole in one of the posts 50 when the two arrays 18*a* and 18*b* are joined. The third array 18*a* and fourth array 18*b* may be attached together by passing self-threading screws or other fasteners through the holes in the tabs 48 and into the holes in the posts 50.

It will be appreciated that further embodiments may include tabs 48 or posts 50 at both ends of one or more of the modular arrays to allow three or more arrays to be attached together in an end-to-end configuration.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An aperture board assembly comprising:

a panel having an array of apertures including a first aperture, each aperture in the array being spaced from an adjacent aperture in the array;

a first modular array of receivers including a first receiver, each receiver of the first modular array being spaced from an adjacent receiver, the first modular array configured to be attached to the panel so that each receiver of the first modular array is substantially aligned with a corresponding aperture in the panel, the first modular array comprising a first continuous integral structure in which the receivers are disposed; and a hook assembly for passing at least partially through the first aperture in the array of apertures and into the first receiver of the first modular array that is aligned with the first aperture, wherein the hook assembly detachably engages the first receiver as the hook assembly is rotated with respect to the panel, wherein the first receiver includes one or more spring clips configured to detachably engage the hook assembly as the hook assembly is rotated with respect to the panel, each of the one or more spring clips comprising a pair of opposing spring fingers that detachably engage the hook assembly as the hook assembly is rotated with respect to the panel.

2. The aperture board assembly of claim 1 further comprising a second modular array of receivers attached to the panel so that each receiver of the second modular array is substantially aligned with a corresponding one of the apertures in the array of apertures in the panel, the second modular array comprising a second continuous integral structure in which the receivers of the second modular array are disposed.

3. The aperture board assembly of claim 2 wherein the second modular array of receivers is disposed adjacent the first modular array.

4. The aperture board assembly of claim 1 wherein the one or more spring clips comprise two or more spring clips which are equally spaced apart around a perimeter of the first receiver.

5. The aperture board assembly of claim 1 wherein:

the hook assembly includes a spoked key comprising a number of radially extending spokes, the number of spokes equal to a number of spring clips of the first receiver; and each pair of opposing spring fingers of the one or more spring clips detachably engages a corresponding one of the spokes of the spoked key as the hook assembly is rotated with respect to the panel.

6. The aperture board assembly of claim 5 wherein:

the number of radially extending spokes is three; and the one or more spring clips of the first receiver comprise three spring clips which detachably engage the three radially extending spokes of the spoked key as the hook assembly is rotated with respect to the panel.

7. The aperture board assembly of claim 1, wherein one or more of the apertures of the array of apertures in the panel are spoked apertures having a spoked shape, and the hook assembly includes a spoked key which matches the spoked shape of the one or more spoked apertures, the spoked key for passing through one of the spoked apertures in the panel and into a receiver aligned with the spoked aperture through which the spoked key passes.

8. The aperture board assembly of claim 1, wherein:

each receiver in the first modular array includes a back plate; and the hook assembly includes one or more springs which engage the back plate of the first receiver as the hook assembly passes at least partially through the first aperture, wherein engagement of the one or more springs against the back plate urges the hook assembly away from the back plate.

9. The aperture board assembly of claim 8, wherein one or more of the apertures of the array of apertures in the panel are one or more spoked apertures having a spoked shape, and the one or more springs of the hook assembly comprise spokes which are configured to match the spoked shape of the one or more spoked apertures in the panel, wherein the spokes of the one or more springs engage the back plate of the first receiver as the hook assembly passes at least partially through the first aperture.

10. The aperture board assembly of claim 1, wherein the first modular array of receivers includes means for attaching the first modular array to a wall, the means for attaching being hidden from view when the panel is attached to the first modular array.

11. The aperture board assembly of claim 1 wherein the hook assembly includes a shank and one or more accessories attached to the shank, wherein the one or more accessories are selected from the group consisting of a hook, a post, a loop, a bracket, a fastener, and a hanger.

12. The aperture board assembly of claim 1 wherein the hook assembly includes a flange configured to substantially hide the first aperture from view when the hook assembly is engaged with the first receiver.

13. The aperture board assembly of claim 1 wherein the first modular array of receivers is an assembly comprising two modular arrays of receivers attached together in an end-to-end configuration.

14. An aperture board assembly comprising:

a panel having an array of apertures, each aperture in the array being spaced from an adjacent aperture in the array according to a first spacing, one or more of the apertures being spoked apertures having a spoked shape, the panel including opposing edge channels;

a modular array of receivers, each receiver being spaced from an adjacent receiver according to the first spacing, the modular array being slidingly received within the edge channels of the panel so that each receiver of the modular array is substantially aligned with a corresponding aperture in the panel, each receiver of the modular array comprising:

a back plate; and a number of spring clips equally spaced apart around a perimeter of the receiver, each spring clip comprising a pair of opposing spring fingers disposed in a spring clip aperture; and a hook assembly comprising:

a spoked key which matches the spoked shape of the one or more spoked apertures in the panel, the spoked key configured to pass through a spoked aperture in the panel and into a receiver aligned with the spoked aperture, the spoked key comprising a number of radially extending key spokes, the number of key spokes of each spoked key matching the number of spring clips of each receiver, each key spoke detachably engaging the opposing spring fingers of a corresponding spring clip as the hook assembly is rotated with respect to the receiver; and one or more springs which engage the back plate of the receiver as the spoked key passes through the spoked aperture, wherein engagement of the one or more springs against the back plate urges the hook assembly away from the back plate.

15. A hook assembly for use on an aperture board, the hook assembly comprising:

a shank for receiving items to be hung on the aperture board;

a flange disposed rearward of the shank, the flange configured to substantially hide from view an aperture of the aperture board into which the hook assembly is inserted;

a spoked key disposed rearward of the flange, the spoked key having a number of radially extending key spokes; and one or more springs disposed rearward of the spoked key, the one or more springs configured to urge the hook assembly in a direction substantially perpendicular to the aperture board when the spoked key is inserted into an aperture in the aperture board, the one or more springs comprising a number of radially extending spring spokes, the number of spring spokes matching the number of key spokes.

16. An aperture board assembly comprising:

a panel having an array of apertures, each aperture in the array being spaced from an adjacent aperture in the array;

a modular array of receivers, each receiver of the modular array of receivers being spaced from an adjacent receiver, the modular array of receivers configured to be attached to the panel so that each receiver of the modular array of receivers is substantially aligned with a corresponding one of the apertures in the panel, each receiver in the modular array of receivers including one or more pairs of opposing spring fingers; and a hook assembly for passing at least partially through one of the apertures in the array of apertures and into one of the receivers in the modular array of receivers that is aligned with the aperture through which the hook assembly passes, wherein the hook assembly detachably engages the one or more pairs of opposing spring fingers of the receiver into which the hook assembly passes as the hook assembly is rotated with respect to the panel.

17. An aperture board assembly comprising:

a panel having an array of apertures, one or more of which are spoked apertures having a spoked shape, each aperture in the array being spaced from an adjacent aperture in the array;

a first modular array of receivers, each receiver of the first modular array including a back plate and being spaced from an adjacent receiver, the first modular array configured to be attached to the panel so that each receiver of the first modular array is substantially aligned with a corresponding aperture in the panel, the first modular array comprising a first continuous integral structure in which the receivers are disposed; and a hook assembly for passing at least partially through an aperture in the panel and into a receiver of the first modular array aligned with the aperture, wherein the hook assembly detachably engages the receiver as the hook assembly is rotated with respect to the panel, the hook assembly including one or more springs that engage the back plate of the receiver as the hook assembly passes at least partially through the aperture, wherein engagement of the one or more springs against the back plate urges the hook assembly away from the back plate, wherein the one or more springs of the hook assembly comprise spokes that are configured to match the spoked shape of the one or more spoked apertures in the panel, wherein the spokes of the one or more springs engage the back plate of the receiver as the hook assembly passes at least partially through the aperture.

* * * * *